US007218198B2

(12) United States Patent
Pilniak et al.

(10) Patent No.: US 7,218,198 B2
(45) Date of Patent: May 15, 2007

(54) COIL FORM

(75) Inventors: Jurgen Pilniak, Warstein/Allagen (DE); Joachim Peck, Soest (DE)

(73) Assignee: DET International Holding Limited, Grand Cayman (KY)

( * ) Notice: Subject to any disclaimer, the term of this patent is extended or adjusted under 35 U.S.C. 154(b) by 0 days.

(21) Appl. No.: 10/530,114

(22) PCT Filed: Apr. 9, 2003

(86) PCT No.: PCT/CH03/00231

§ 371 (c)(1),
(2), (4) Date: Jan. 26, 2006

(87) PCT Pub. No.: WO2004/032158

PCT Pub. Date: Apr. 15, 2004

(65) Prior Publication Data

US 2006/0132275 A1 Jun. 22, 2006

(51) Int. Cl.
*H01F 27/30* (2006.01)
*H01F 27/24* (2006.01)

(52) U.S. Cl. ..... 336/208; 336/198; 336/212

(58) Field of Classification Search ..... 336/208, 336/198, 192, 212
See application file for complete search history.

(56) References Cited

U.S. PATENT DOCUMENTS 3,661,342 A * 5/1972 Sears ..... 242/118.41
3,851,287 A 11/1974 Miller et al.
4,449,111 A 5/1984 Nakajima
4,652,846 A 3/1987 Sobottka
4,857,876 A * 8/1989 Costa ..... 336/165
4,904,975 A 2/1990 Medenbach
6,008,708 A * 12/1999 Endoh et al. ..... 335/151
6,727,793 B2 * 4/2004 Piechnick ..... 336/198
7,084,728 B2 * 8/2006 Hyvonen ..... 336/84 C

FOREIGN PATENT DOCUMENTS

| | | |
|---|---|---|
| DE | 195 05 463 | 8/1995 |
| EP | 0 133 661 | 3/1986 |
| EP | 0 293 617 | 12/1988 |
| FR | 2 233 694 | 6/1973 |
| FR | 2 476 898 | 2/1980 |
| GB | 2 257 307 | 1/1993 |
| JP | 06 181 132 | 6/1994 |
| WO | WO 01/78090 | 10/2001 |

* cited by examiner

*Primary Examiner*—Anh Mai
(74) *Attorney, Agent, or Firm*—Gallagher & Kennedy, P.A; Thomas D. MacBlain

(57) ABSTRACT

A coil form for forming an inductive element (10) includes a coil body (2) and at least one, for example three separating plates (3). The coil body (2) has an opening (4.1) and includes two portions, a coil portion (6) and a flange portion (7). To put the inductive element (10) together, the separating plates (3) are pushed over the coil portion (6) of the coil body (2). The separating plates (3) divide the surface of the coil portion (2) into a plurality of coil areas where the coil or the coils of the inductive component (10) can be provided, for example by winding an isolated wire around the coil portion (6) in a coil area. The separating plates are made of metal and form another coil of the inductive component. Afterwards, the core of the inductive component is installed by fitting the two E-shaped core parts (11.1, 11.2) together such that the middle leg (13) of each core part (11.1, 11.2) is inserted into the opening (4.1) of the core body (2).

20 Claims, 4 Drawing Sheets

COIL FORM

TECHNICAL FIELD

The invention relates to a coil form for forming an inductive element with a core, including a first and a second coil, a hollow coil body for insertion of the core, the coil body being made of an electrically insulating material and having a coil area on its outer surface for holding a wire that forms a part of the first coil and a separating plate which surrounds the outer surface of the coil body thereby providing said coil area. The invention further relates to an inductive element and a coil form having a hollow coil body for insertion of a core of an inductive element and having an outer surface for holding a coil of the inductive element.

BACKGROUND

In the manufacturing of electric and/or electronic components exists an ongoing demand for smaller components while their power density should be increased at the same time. This is particularly true in the manufacturing of inductive elements such as transformers, inductors or chokes. One of the major problems when reducing the size of inductive elements is to dissipate the heat, which is generated within the magnetic circuit, efficiently.

Document EP 0 133 661 shows a transformer type, which is widely known in the art, either in the formation shown or in different variations. Each winding of the transformer is wound on a separate coil body which comprises a flange on each end to hold the windings in the correct position. When the transformer is fitted together, a thin metal foil is inserted between two adjacent coil bodies to provide for electrical isolation as well as for shielding.

Since this transformer does not include an efficient cooling of the circuit, it is not suited for high power applications and its leakage inductance is quite bad.

Another transformer is described in the publication FR 2 476 898. The transformer comprises a magnetic core with three legs where all of the windings of the transformer are formed by a plurality of flat coils. As the coils are positioned directly one after another, they are electrically isolated all of their surface. The coils generally have a rectangular shape, include an air gap and are provided directly around the middle core leg.

This transformer too does not provide for an efficient cooling. The flat coils are electrically isolated which presents an efficient heat dissipation. Furthermore, this type of transformer can not be used in applications, where at least one of the transformer windings shall bed realised with isolated copper wires.

In order to provide transformers that require only a small space, planar transformers where the windings are formed by copper traces that are etched on a printed circuit board, have been introduced. Furthermore, different cooling methods are known to enhance heat dissipation. However, while planar transformers are suited very well in certain applications, they are not useful in other applications.

SUMMARY

It is therefore an object of the invention to provide a coil form of the kind initially mentioned, particularly to provide a coil form for forming of a small transformer with enhanced heat dissipation capabilities.

A coil form according to an object of the invention is designed to form an inductive element with a magnetic core and at least two coils, i.e. a first and a second coil. The coil form includes a hollow coil body for insertion of the core and has a coil area on its outer surface for holding a wire that forms a part of the first coil. The boil body is made of an electrically insulating material such as for example a ceramic or synthetic material such as plastics or the like. The coil body is preferably manufactured with injection moulding, utilising a polymeric material such as for example a glass fiber reinforced liquid crystal polymer. The first coil can for example be realised by an insulated wire which is wound around the surface of the coil body in the coil area. Such a wire winding typically forms a part of a primary winding of the inductive element.

The coil form further includes a separating plate which surrounds the outer surface of the coil body and thereby provides the coil area on the surface of the coil body. While the coil body is made of an electrically insulating material, the separating plate is made of metal and has an opening for pushing the separating plate over the coil body. According to the invention, the separating plate, which has a slit that prohibits short circuits and leakage currents within the separating plate, forms a winding of the second coil. By providing a plurality of separating plates and connecting them in a suitable way, it is possible to provide a coil with a plurality of windings. As the number of windings of such a coil typically is smaller than the number of windings of the first, wired coil, the plate winding coil typically is a secondary winding of the inductive element, leading a higher current than the primary wire winding.

Fabricating the separating plate from metal and utilising it as a winding of a coil of the inductive element results in several advantages of the invention. First of all, the metallic plate helps to dissipate the heat which is generated either within the plate or within the coils which are positioned directly adjacent to the plate. Efficient cooling of the inductive element can be achieved. Another advantage is that the separating plate serves as a side support for the coils that are provided within the coil area or coil areas. Furthermore, the metallic plates have a positive effect on the leakage inductances, the inductive coupling between the primary and the secondary and the overall stability of the coil form and since the separating plates fulfil several functions at the same time, the costs and the manufacturing demand can be reduced because less material and less manufacturing steps are necessary to produce an inductive element according to the invention.

If a separating plate is used as a winding, the separating plate has two terminal projections, that are positioned preferably in the region of the slit. These terminal projections are for example built such that the separating plate or the separating plates can be easily interconnected together or connected to a printed circuit board. The circuit board includes corresponding holes or slits where the terminal projections can be inserted and for example bonded to by solder.

While many different shapes of the coil body are possible, for example a coil body that has an overall cylindrical shape, the coil body preferably includes two portions, a coil portion and a flange portion on an end region of the coil portion. The coil portion is of the kind of a hollow cylinder on the surface of which the coils of the inductive element are provided. The core of the inductive element or at least a part of it is insertable into the coil portion. The orientation of the cylindrical coil portion corresponds to the axis of the core and the base plane of the cylinder is perpendicular to that axis. The plane defined by the flange portion is substantially parallel to that base plane of the coil portion. When a separating plate is slipped over the coil portion, the flange portion forms a side support for the separating plate for positioning and holding the separating plate in the correct position. In the correct position, the separating plate lies in a plane that, again, is parallel to the base plane of the cylindrical coil portion.

In a preferred embodiment of the invention, the coil form includes at least two separating plates and a second flange portion on a second end region of the coil portion, that is on the end region of the coil portion that is opposite to the first flange portion and where the separating plates are pushed over the coil portion. Here, the plane defined by the second flange portion also is parallel to the base plane of the cylindrical coil portion. The second flange portion forms a side support for the second, or generally spoken, the last separating plate that is pushed over the coil portion.

If the coil form includes four or more separating plates, the coil portion includes at least one projection that surrounds the outer surface of the coil body thereby forming a side support for two inner separating plates. The distances between two adjacent separating plates can be chosen freely to provide a plurality of coil areas of different widths. However, it is preferred, that the separating plates are equally spaced at a specific plate-distance. This produces coil areas that are equal in width.

The choice of the plate-distance depends on the number of desired windings of the wire windings provided within the coil areas and the wire itself. In a preferred embodiment of the invention, the plate-distance and the wire are chosen such that the ratio of the plate-distance to a diameter of the wire is between 1 and 2 and even more preferred is a value of said ratio between 1.1 and 1.4. Such a choice of the plate-distance and the wire diameter ensures that each winding of the wire winding wound in such a coil area is in direct contact with at least one separating plate, resulting in an even more increased heat dissipation capability of the resulting inductive element. The cross section of the wire is preferably circular. However, a wire with any other cross section, for instance an elliptic or a polygonal (rectangular or quadratic) cross section can be utilised.

The process of winding a wire in a coil area starts on the outer surface of the coil portion, that is at the bottom of the winding chamber formed by a coil area and the two separating plates on the left and on the right. In another preferred embodiment of the invention, the wire for winding around the coil portion to provide a wire winding is not fed from the top of a winding chamber to its bottom, but from the inside of the coil portion to the bottom of the coil area through a hole in the coil portion. This results in a reduced overall height of the inductive element. From the inside of the coil portion, the wire is fed to the outside through a recess on an inner surface of the coil portion. The recess provides enough room for the wire when the core is inserted into the coil form. To achieve short wire paths, the opening to feed the wire from the inside of the coil form to a winding chamber is positioned in a region of the recess, where the wire is fed into the inside of the coil form.

In order to connect a wire to another wire or to an electric or electronic circuit, the first flange portion includes a plurality of terminals. A terminal is for example formed by a hole in the first flange portion and a metallic pin that is inserted into a hole. The pin can have any cross section, but a pin with a quadratic cross section is preferably utilised. Then, an end of a wire is electrically conductively connectable to a terminal for example by soldering the wire to a pin. The size, shape and arrangement of the terminals can be such that they can be connected directly to corresponding taps or connectors of a printed circuit board or the like.

Depending on the requirements, one separating plate can be enough to form the second coil, namely in the case where only one winding is necessary to form the second coil. However, in an advantageous embodiment of the invention, two or more separating plates are electrically conductively connected to form a plurality of windings of the second coil.

The separating plate, either its outline or the outline of its opening, can be of any shape. However, it is advantageous to choose the shape of the opening of the separating plate such that is substantially corresponds to the shape of the outer surface of the coil portion of the coil body. The shape of the separating plate is chosen such that at least a part of an internal diameter of the separating plate (the diameter or width of the opening) is smaller than a corresponding outer diameter of the coil body. This means that the opening of the separating plate is at least partially smaller than the coil body.

Therefore, either the coil body or the separating plate have to be deformed to push the separating plate in its correct position. In order to deform the separating plate, which is made of metal, it would have to be made very thin, which would cause unwanted instabilities of the coil form. It is more useful to build the coil body such that it is deformable either by providing it with a corresponding structure of the coil body and/or by using a flexible electrically insulating material.

It can also be achieved by a divided coil body which comprises at least two elements. The elements are formed such that they include means to fit them together to form the coil body. Hence, the coil body can be pressed together in order to push the separating plate in its correct position on the outside of the coil body.

While the divided coil body can comprise three or more elements, it is sufficient that is comprises only two elements. While any kind of positive or non-positive locking is suited to connect the elements, it is preferred that the means to fit the two elements together include a recess on the first element and a corresponding projection on the second element.

There are many ways to divide the coil body into two elements. One can for example think of almost any plane which intersects the coil body to divide it into two elements. However, as the coil portion of the coil body according to the invention is preferably built of the kind of a right cylinder where the base planes are perpendicular to the outer surface of the coil portion, the coil body is preferably divided into two elements by a lane which is perpendicular to a base lane of the right cylindrical coil portion.

As described before, on possibility for positioning and holding the separating plate in the desired position is to provide a projection that surrounds the coil portion. Another preferred possibility is to use a coil portion with a slightly larger diameter and provide a recess at the desired position of the separating plate.

The coils of the inductive element, which are provided on the surface of the coil body, have to be connected to a corresponding electrical circuit. The ends of the coils could be connected directly to another component of the electrical circuit or to a corresponding contact bank where the electrical circuit is connected to as well.

In an advantageous embodiment of the invention, the flange portion includes a plurality of terminals where at least an end of the at least one coil is electrically conductively connectable to one on the terminals. The size, shape and arrangement of the terminals can be such that they can be connected directly to corresponding taps or connectors of a printed circuit board or the like.

An inductive element according to the invention is manufactured by utilising a coil form according to the invention as described above. A magnetic core is inserted into the hollow coil body of the coil form and the separating plate is pushed over the coil body. At least one coil is provided on the outer surface of the coil body.

Although one metal separating plate would be sufficient to provide an inductive element according to the invention, in some applications, the inductive element advantageously includes a plurality of metal separating plates. This can be done for example to increase the number of coil areas or, where the separating plates form a winding of a coil, to increase the number of windings of such a coil.

In order to increase the number of windings of a plate winding coil, two or more separating plates can be provided directly one after the other without forming any coil areas between two adjacent plates. To prevent short circuits between two adjacent separating plates, an isolation plate (electrical isolation) is provided between two adjacent separating plates. The shape of such an isolation plate corresponds to the shape of the separating plates. As an isolation plate does not conduct electrical current, there is no slit necessary in an isolation plate.

The coil form according to the invention is suited to implement many different types of inductive elements like for example different types of transformers, inductors or chokes for usage in many different applications. It is also possible to utilise magnetic cores with different shapes such as for example E, U or I-shaped cores.

A widely used core type has a double rectangular shape, that is a core with two rectangular portions that have a common edge. To manufacture an inductive element according to the invention, the utilisation of such double rectangular core is preferred and where the common edge of the core is inserted into the hollow coil body.

To build such a double rectangular core, an E-shaped and an I-shaped part could be used and the middle leg of the E-shaped part is inserted into the coil body. Advantageously it can also be built from two E-shaped core halves where the middle leg of each core half is inserted into the coil body from one side of the coil body respectively.

In order to further increase the power transmission capabilities, two or more coil forms are connected in a further embodiment of an inductive element according to the invention so that their coil bodies form one long, cylindrical, hollow coil body. Here the inductive element is produced by inserting the middle leg of the core into this long coil body thereby inserting the core leg into each coil body. If necessary, the wire windings and the plate windings can be interconnected through the pins in the coil bodies and the terminal projections of the separating plates respectively.

Coil bodies which comprise two or more elements that can be fitted together by corresponding fitting means, can also be used without metal separating plates. That is they can be used in coil forms, where the separating plates are not made of metal but made of an electrically insulating material.

In such coil forms, the coil body and the separating plate can build up one single piece or the separating plates can, according to another embodiment, form an additional part of the coil form. They can form for example a hollow outer coil body which can be fitted over the (inner) coil body. The separating plate can be fitted over the outer coil body to provide the coil areas. The advantage of such a configuration is, that different kinds of outer coil bodies can be premanufactured and fitted over the (inner) coil body to realise different kinds of coil forms with a single (inner) coil body.

The method for forming an inductive element with a hollow coil body, a core, a first coil and a second coil according to the invention is defined in claim 21. A winding of the second coil is provided by pushing a metallic separating plate with an opening over the coil body and a part of the first coil (16) is provided by winding a wire in a coil area around an outer surface of the coil body.

Typically, winding a wire around a coil body starts on the surface of the coil body, that is at the bottom of the coil area. Therefore, the wire has to be fed to the surface of the coil body which can be done by feeding it from the outside of the coil body directly to the surface of the coil body. In a preferred embodiment of the invention, the wire is fed from an outside of the coil body to an inside of the coil body through the hollow part where the core is inserted into the coil body, through a recess on an inner surface of the coil body and from said recess to the outer surface of the coil body through an opening in the coil body, where the opening is positioned in a region of said recess.

The coil area where the first coil is wound around the coil body is provided by pushing at least two metallic separating plates over the coil body and positioning the separating plates at a specific plate-distance. The coil area, i.e. the outer surface of the coil body forms the bottom of the winding chamber and the separating plates form the side walls of the winding chamber.

If more than one winding chamber is necessary, three or more metallic separating plates are slipped over the coil body and equally spaced at a specific plate-distance. In each winding chamber, at least one wire is wound around the outer surface of the coil body to provide a plurality of first coils. According to the requirements, none, two or more of them can be connected to form one or more coils of the resulting inductive element.

While the wires in each winding chamber can be wound sequentially, it is preferred that all wires are wound around the coil body simultaneously, which has several advantages. Since the wire windings are produced faster, the costs can be reduced. Furthermore, the production quality can be improved because none of the separating plates gets out of place due to the winding pressure during the winding process that is more or less the same on both sides of the separating plate.

From the following detailed description and from the entirety of the claims it will be clear to a person skilled in the art, that there are more advantageous embodiments and feature combinations of the invention.

DESCRIPTION OF THE DRAWINGS

The drawings used for illustration of the examples show.

In general, the same objects in different drawings are given the same reference numerals.

DETAILED DESCRIPTION OF THE PREFERRED EMBODIMENTS

Figure 1:
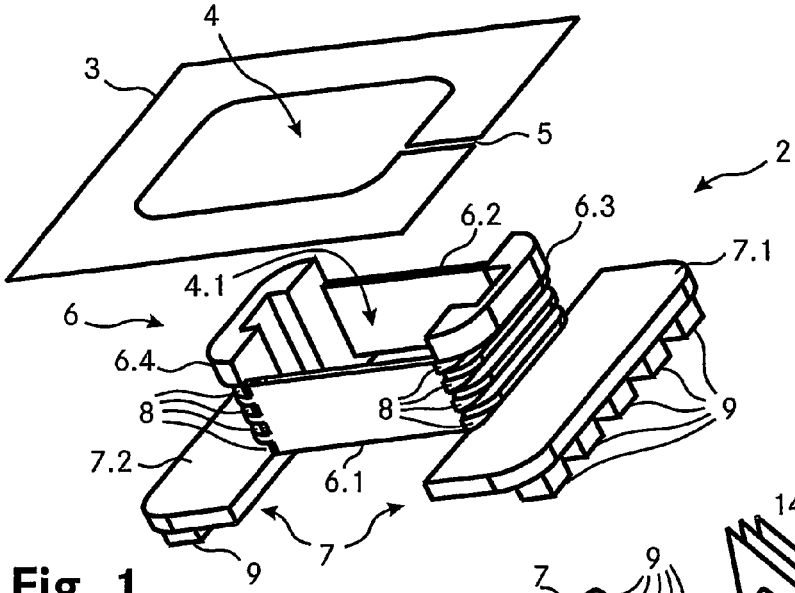
FIG. 1 A coil form according to the invention in a perspective view.

FIG. 1 shows a perspective view of a coil form 1. The coil form 1 includes a coil body 2 ad a separating plate 3. The separating plate 3 is for example made of copper or aluminium or any other metal with high heat conducting capabilities and has a thickness of about 0.3 mm to 0.5 mm. The separating plate 3 has a rectangular shape, comprises an opening 4 with a rectangular shape as well and includes a slit 5 which is directed from the outer boarder to the opening 4, thereby interrupting any conductive path around the opening 4 of the separating plate 3.

The coil body 2 which is for example made of a glass fiber reinforced liquid crystal polymer comprises a coil portion 6 and a flange portion 7. The coil portion 6 has substantially the shape of a hollow right cylinder with four side walls 6.1, 6.2, 6.3, 6.4 around an opening 4.1 for insertion of a magnetic core (not shown) of a transformer. The flange portion 7 is divided into two flange parts 7.1, 7.2, where each flange part 7.1, 7.2 is connected to one of the side walls 6.3, 6.4. On the outer surface of the side walls 6.3, 6.4 recesses 8 are provided for positioning separating plates 3 after fitting them over the coil portion 6.

On the lower side of the flange portion 7, terminals 9 are located. Due to the perspective view of FIG. 1, some of the terminals 9 are not visible.

Figure 2:
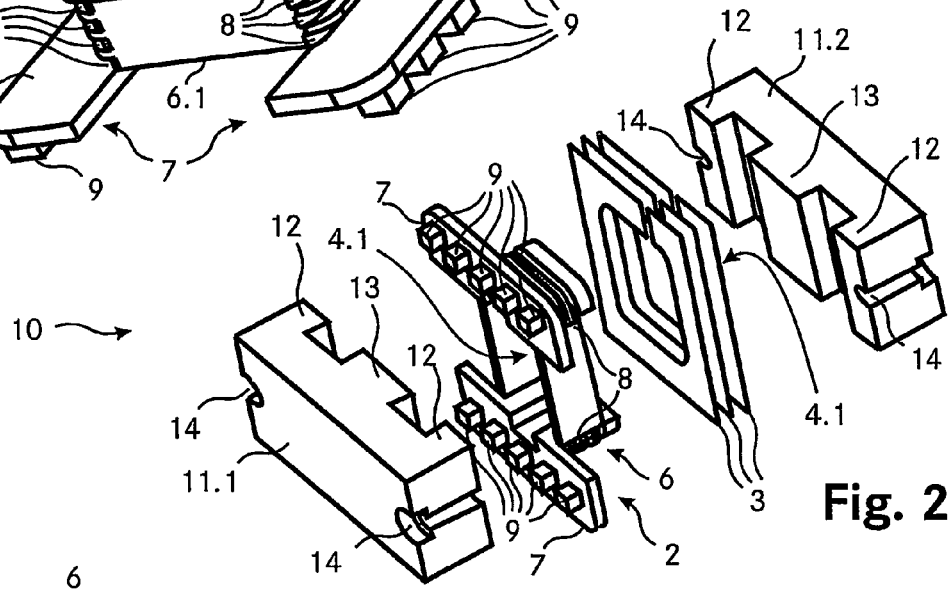
FIG. 2 a transformer body with the coil form shown in FIG. 1 in a perspective, exploded view.
Figure 3:
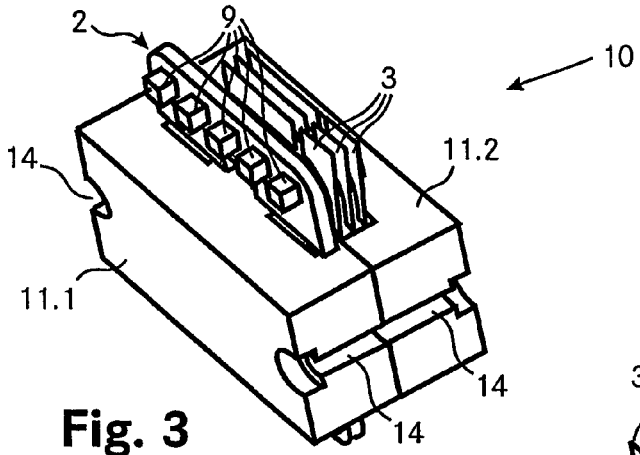
FIG. 3 the assembled transformer from FIG. 2.

In FIG. 2, an exploded perspective view of a transformer body 10 with the coil form 1 is shown. FIG. 3 shows the same transformer body 10 assembled. Unlike in FIG. 1, three separating plates 3 are provided. The transformer body 10 includes a magnetic core 11 which consists of two E-shaped core parts 11.1, 11.2 which include two outer legs 12 and a middle leg 13 respectively. The recesses 14 on the outer legs 12 are provided for mounting clamps (not shown) to hold and press the E-shaped parts 11.1, 11.2 of the core 11 together. It is to mention that the needed wire windings have to be wound around the coil body 2 before the clamps are mounted around the transformer body 10.

To assemble the transformer body 10, the separating plates 3 are pressed over the coil body 2 and then the E-shaped parts 11.1, 11.2 of the core 11 are fitted together by inserting the middle legs 13 into the opening 4.1. E-shaped part 11.1 is inserted from the front (as shown in FIG. 2) and E-shaped part 11.2 is inserted into the opening 4.1 from behind. Then the transformer body is clamped together for example by mounting clamps in the recesses 14.

In the assembled transformer body 10, both outer separating plates 3 are directly in touch with the E-shaped parts 11.1, 11.2 of the core 11. Hence, the heat generated within the windings of the transformer can be efficiently dissipated via the separating plates 3 to the core 11, which functions as a heat sink.

Figure 4:
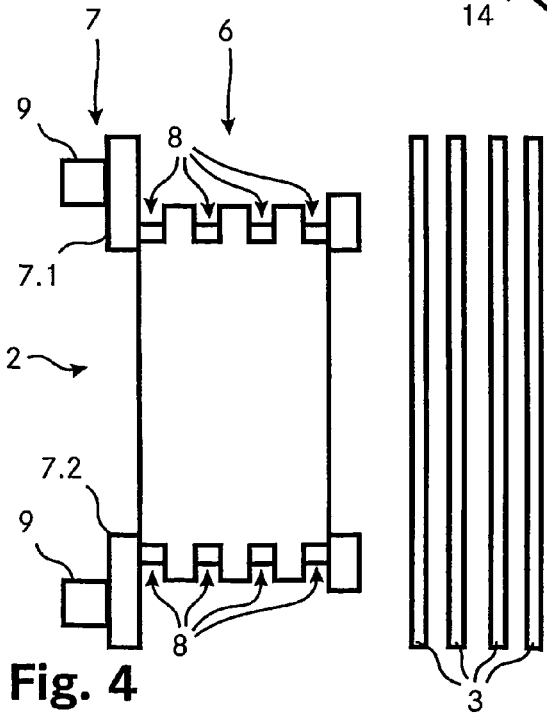
FIG. 4 the coil form as shown in FIG. 1 in a side view.

FIG. 4 shows the coil body 2 with three separating plates 3 in a side view. The separating plates 3 are not yet fitted over the coil portion 6 and no wire windings are provided on the surface of the coil portion 6. In this view, the recesses 8 for holding the separating plates 3 and the terminals 9 on the flange parts 7.1, 7.2 can be seen clearly.

Figure 5:
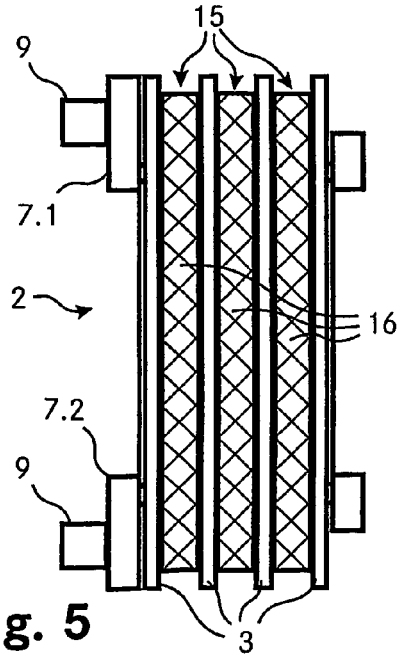
FIG. 5 the coil form as shown in FIG. 3 assembled and with wire windings.

FIG. 5 shows the same coil body 2 as FIG. 4 but here, the three separating plates 3 are fitted over the coil portion 6 thereby dividing the surface of the coil portion 6 into three coil areas 15. In each of these coil areas 15, a wire winding 16 is provided on the surface of the coil portion 6.

When a transformer with a coil body 2 as shown in FIG. 5 is in operation, the wire windings 15 generate a lot of heat. This heat is generated just near the separating plates 3 which are made of a metal such as for example copper or aluminium or any other metal with high heat conducting capabilities. This means that the separating plates not only serve as a side support for the wire windings 15 but also dissipate the heat generated within the wire windings 15 efficiently. As mentioned above, the separating plates 3, or at least some of them, are in direct contact with the core 11 which helps to dissipate even more heat.

At this point, it is to mention, that FIG. 5 shows a small space between the outermost separating plates 3 and the flange portion 7 and the other wide of the coil body 2. However, as the separating plates 3 are in direct contact with the flange portion 7 (and with the smaller flange portion on the other side), there are no such spaces. This is also true for other figures, such as for example FIG. 8, where there seems to be a small space between the separating plates 3.1 and the insulation plates 19.

Figure 6:
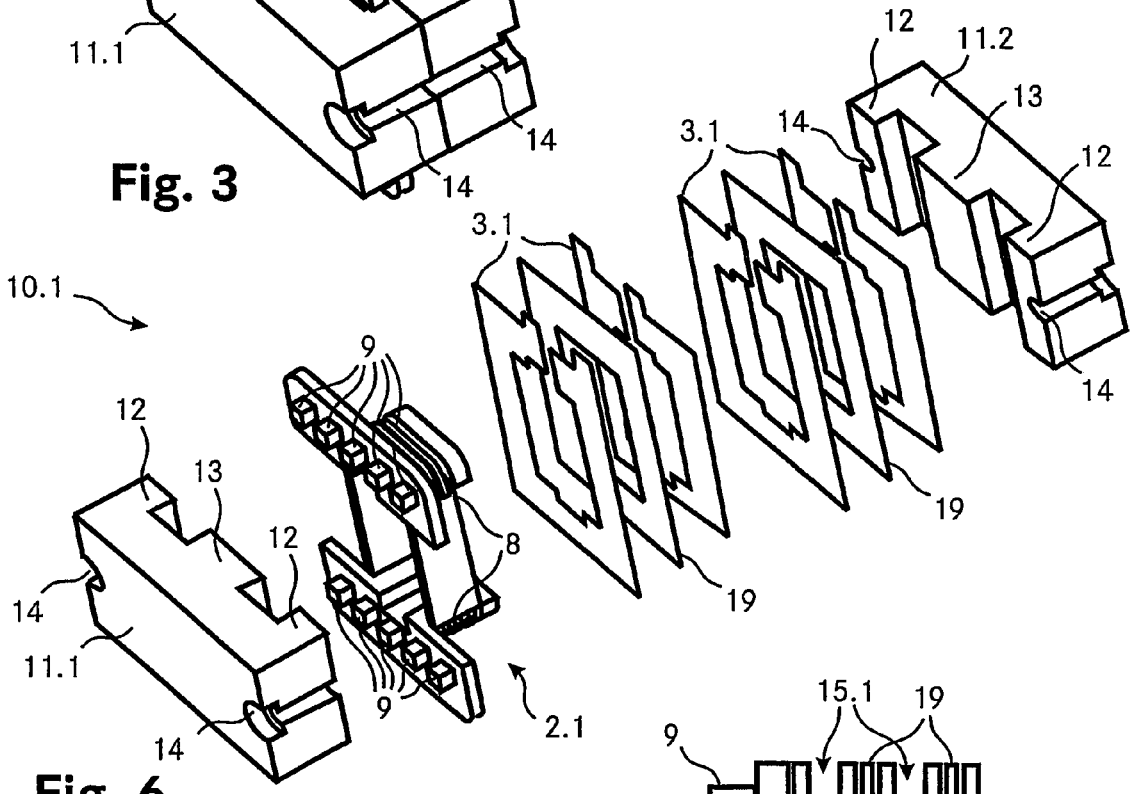
FIG. 6 a further transformer body in an exploded perspective view.

FIG. 6 shows an exploded perspective view of another transformer body 10.1 with a further embodiment of a coil form 1.1 according to the invention. The coil body 2.1 is almost the same as the coil body 2 in the transformer body 10 of FIG. 2. The only difference is, that it comprises just two recesses 8 on the surface of the coil portion 6.1.

Figure 7:
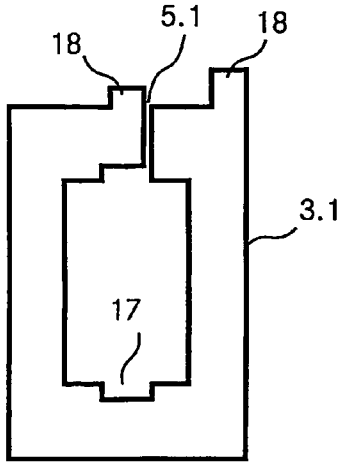
FIG. 7 a separation plate of the transformer of FIG. 6.

There are four separating plates 3.1 which are arranged in two groups and which have slightly a different shape than the separating plates 3 of FIGS. 1 and 2. The shape of the separating plates 3.1 is shown in more details in FIG. 7. The separating plates 3.1 have a recess 17 on the lower edge of the opening 4 and on both sides of the slit 5.1 they have a terminal projection 18. At this point it is to say that, although all of the four separating plates 3.1 have the same shape, two of them (that is one in each group as shown in FIG. 6) are laterally reversed.

As already mentioned, the separating plates 3.1 are arranged in two groups, where each group includes two separating pates 3.1, one of them being laterally reversed. To prevent current flow from one separating plate to another within a group, an insulation plate 19 is provided between the two separating plates 3.1 of one group.

The terminal projections 18 can be used to connect the separating plates 3.1 to a printed circuit board (not shown) with corresponding holes or slits where the terminal projections 18 can be inserted and for example bonded to by solder.

Then, the separating plates 3.1 can be interconnected in the desired manner by traces on the printed circuit board to form the necessary windings.

Figure 8:
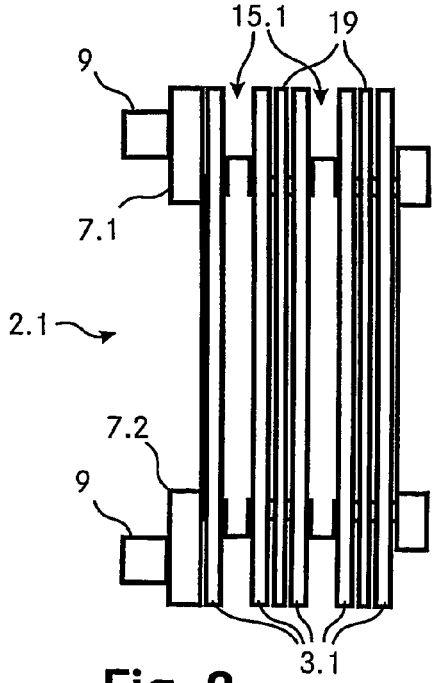
FIG. 8 the coil form of FIG. 6 with assembled separating plates.

FIG. 8 shows the coil body 2.1 of FIG. 6 in a side view. On the outer surface of the coil portion 6.1 two recesses 8 are provided where the two plate groups, each group including two separating plates 3.1 and an insulation plate 19 between them, are positioned. The plate groups divide the outer surface of the coil body 2.1 into two coil areas 15.1.

Within the coil areas 15.1 two wire windings (not shown) can be provided in a similar way as shown in FIG. 5. These wire windings could for example form one (or more) primary windings of a transformer, while the separating plates 3.1 form one (or more) secondary windings of the transformer. For this purpose, the terminal projections 18 of the separating plates 3.1 are electrically conductively connected such that the needed number of coils with the necessary number of turns in the correct direction results. In this case, where the separating plates 3.1 are utilised as a coil of the inductive element, they have not only to be made of a good heat conducting material, but the material has also to be a good electrical conductor. Hence, it is preferred to make the separating plates of copper or aluminium or any other metal with high heat and electrical current conducting capabilities.

Figure 9:
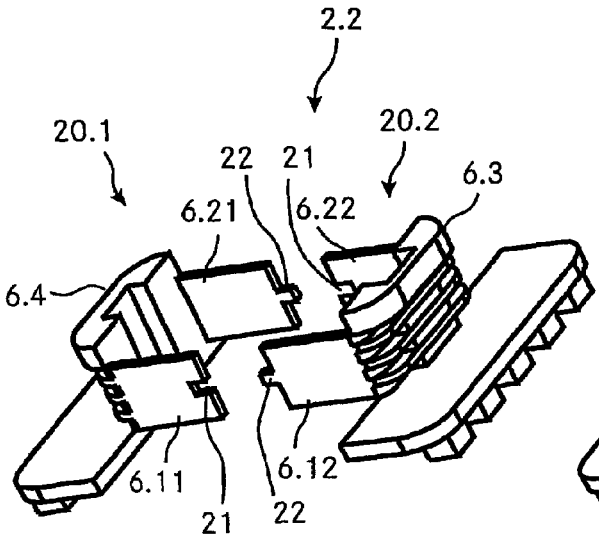
FIG. 9 a divided coil body according to the invention in an exploded view.
Figure 10:
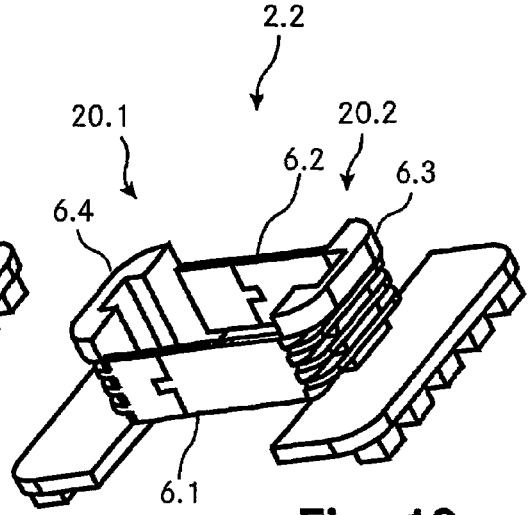
FIG. 10 the assembled divided coil body from FIG. 8.

FIGS. 9 and 10 show a coil body 2.2 which is very similar to the coil body 2 of FIG. 1. The difference is, that the coil body 2.2 is divided into two elements 20.1, 20.2. FIG. 9 shows the assembled coil body 2.2 where the two elements 20.1, 20.2 are fitted together and FIG. 10 shows the coil body 2.2 in an exploded view.

The coil body 2.2 is divided along a plane which is parallel to the planes of the side walls 6.3 and 6.4 and divides each of the side walls 6.1, 6.2 in two side wall sections 6.11, 6.12 and 6.21, 6.22 respectively.

To fit the elements 20.1, 20.2 together, there is a recess 21 provided on the front edge of side wall sections 6.12 and 6.21 and a corresponding projection 22 is provided on the front edge of side wall sections 6.11 and 6.22.

Figure 11:
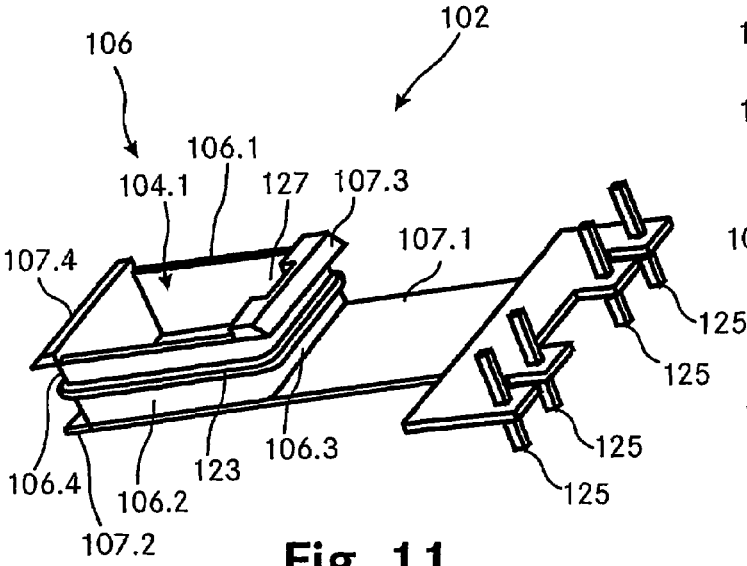
FIG. 11 a coil body of another coil form according to the invention in a perspective view.
Figure 13:
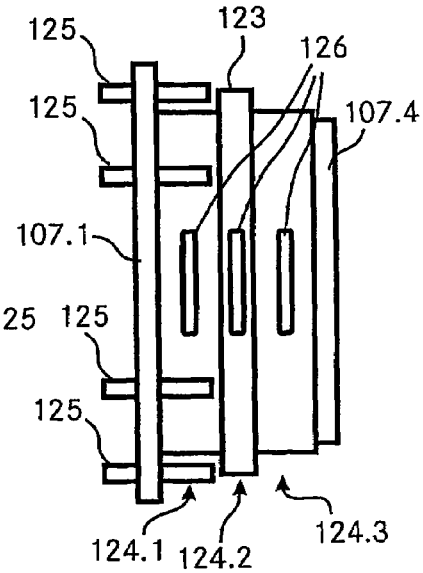
FIG. 13 the coil body of FIG. 11 viewed from the top.
Figure 12:
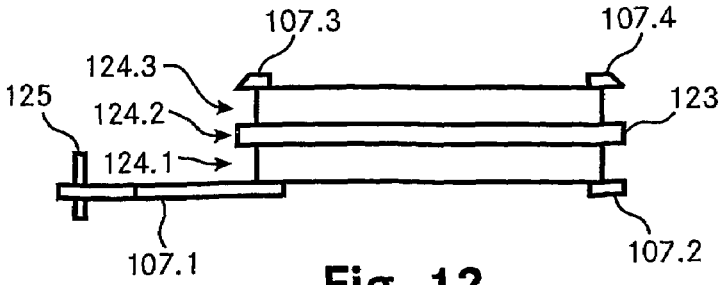
FIG. 12 the coil body of FIG. 11 in a side view.

In FIG. 11–14 another coil body 102 of a coil form according to the invention is shown. FIG. 11 shows a perspective view, FIG. 12 a side view, FIG. 13 a top view and FIG. 14 a front view of the coil body 102. The coil body 102 comprises a coil portion 106 that has substantially the shape of a hollow right cylinder with four side walls 106.1, 106.2, 106.3, 106.4 around an opening 104.1 for insertion of a magnetic core (not shown) of a transformer. The coil body 102 further comprises two flange portions, each being divided into two flange parts 107.1, 107.2, 107.3, 107.4 where each flange part 107.1, 107.2, 107.3, 1074. is connected to one of the side walls 106.3, 106.4 respectively. On the outer surface of the coil body 102 a projection 123 is provided that surrounds the coil body 102 and divides its outer surface into three winding chambers 124.1, 124.2, 124.3, namely two winding chambers 124.1, 124.3 directly on the surface of the coil body 102 and one winding chamber 124.2 on the outer surface of the surrounding projection 123.

The flange part 107.1 is longer than the flange part 107.2 and includes four little holes where a metallic pin 125 is inserted into each hole. In the example shown, the cross section of the pin is quadratic with a diagonal of about 1.4 mm while the holes in the flange part 107.1 are circular with a diameter of about 1.2 mm.

Figure 15:
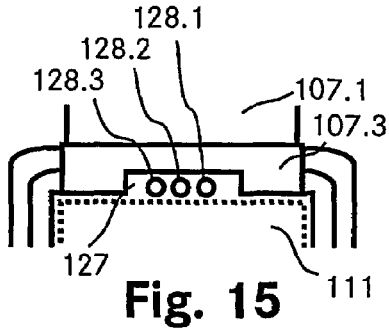
FIG. 15 a detailed view of the coil body of FIG. 11 with an inserted magnetic core.

The side wall 106.3 comprises on its inner surface a recess 127. FIG. 15 shows a detailed view of this recess 127 with a magnetic core 111 inserted into the coil body 102 and a plurality of wires 128.1, 128.2, 128.3 that are fed from the outside of the coil body 102 to its inside through the recess 127, i.e. between the coil body 102 and the core 111. The side wall 106.3 further comprises a plurality of openings in the form of slits 126 through which the wires 128.1, 128.2, 128.3 are fed from the recess 127 to the outer surface of the coil body 102. The slits 126 are positioned such that they are located in each winding chamber 124.1, 124.2, 124.3 on the surface of the coil body 102 or the projection 123, preferably in the center of each winding chamber 124.1, 124.2, 124.3.

Figure 14:
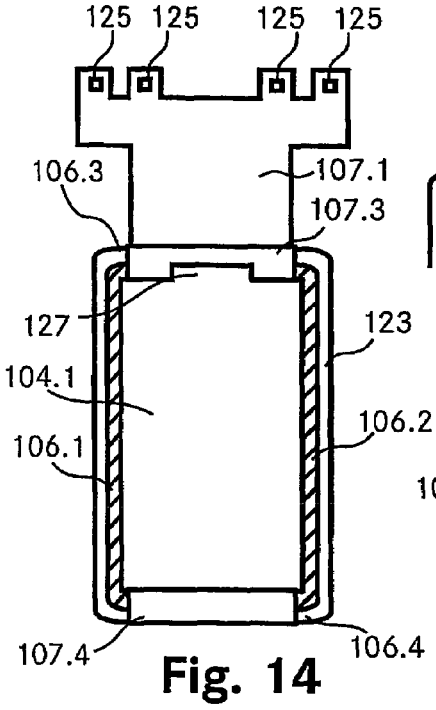
FIG. 14 the coil body of FIG. 11 in a front view.
Figure 16:
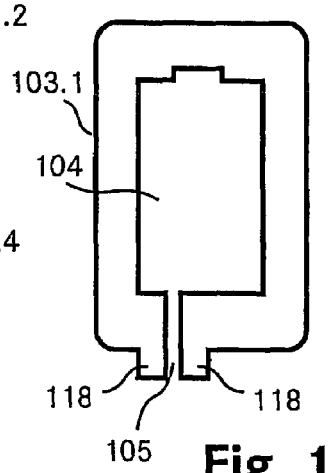
FIG. 16 a first kind of separating plate for the coil body of FIG. 11.

FIG. 16 shows a separating plate 103.1 for slipping over the coil body 102 in order to form the windings of a coil of the resulting inductive element. The separating plate 103.1 is a metallic sheet with an opening 104 the shape of which substantially corresponds to the shape of the outer surface of the coil body 102 as seen in FIG. 14 from the front. The separating plate 103.1 further includes two terminal projections 118 for connecting the separating plate 103.1 to another separating plate or to an electric and/or electronic circuit (not shown). The separating plate 103.1 further includes a slit 105 that is directed from the outer boarder to the opening 104 and interrupts any conductive path around the opening 104 of the separating plate 103.1.

Figure 19:
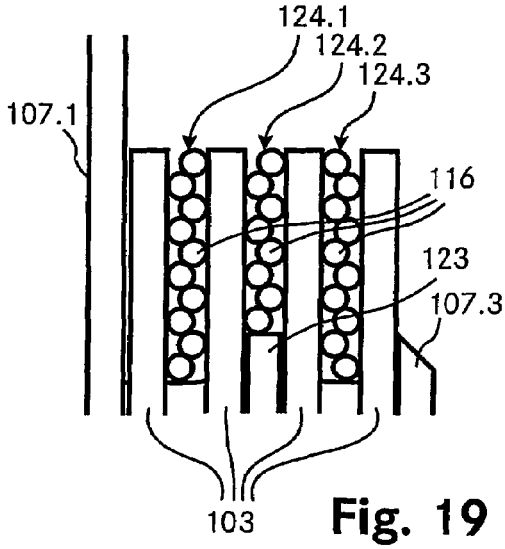
FIG. 19 a detailed view of a first inductive element with the coil body if FIG. 11 and FIG. 20 a detailed view of a second inductive element with the coil body of FIG. 11.

In FIG. 19, a detailed view of an inductive element with the coil body as shown in FIG. 11–14 and three wire windings 116 wound around the surface of the coil body 102 in the three winding chambers 124.1, 124.2, 124.3 provided by the four separating plates 103 is shown. The separating plates 103 correspond to the separating plate 103.1 as shown in FIG. 16 or to a separating plate with a similar shape but with differently arranged terminal projections. The flange parts 107.1, 107.2 form a side support for the separating plate 103 that is pushed over the coil body 102 first. The left side (according to the orientation as shown in the drawing) of the projection 123 forms a side support for the second separating plate 103 and the right side of the projection 123 forms a side support for the third separating plate 103. The flange parts 107.3, 107.4 form a side support for the fourth separating plate 103.

While the wire windings 116 form one or more primary coils of the resulting inductive element, the separating plates 103 form one or more secondary coils of the inductive element. The number of primary and secondary coils and the number of turns within each coil depends on the application and can be varied within a wide range by changing the number of turns, the number of strands or the wire diameter of the wire windings 116, the number of separating plates 103 and by connecting the wire windings 116 and the separating plates 103 in a suitable way.

The winding process of the wire windings 116 starts by feeding the wires 128.1, 128.2, 128.3 through the recess 127 and the slits 126 to the outer surface of the coil body 102. It would also be possible to feed the other end of a wire 128.1, 128.2, 128.3 first from the outer surface of the coil body 102 to its inner side through the slits 126 and then through the recess 127 to the outside of the coil body again. Then the wires 128.1 and 128.3 that form the wire windings 116 in the winding chamber 124.1, 124.3 are wound around the coil body 102 only once, thereby pressing the four separating plates 103 against their side supports, namely the flange parts 107.1, 107.2, 107.3, 107.4 and the projection 123. Then all three wires 128.1, 128.2, 128.3 are wound around the coil body 102 simultaneously. After the winding the ends of the wires are connected to the pins 125 in the desired way, either to interconnect some of the windings or to connect them to an electric and/or electronic circuit (not shown).

Due to the fact that the width of the winding chambers 124.1, 124.2, 124.3 is only a little bit larger than the diameter of the isolated wires 128.1, 128.2, 128.3, each winding of the wire windings 116 is in direct contact with one of the metallic separating plates 103 that form the boundaries of the winding chambers 124.1, 124.2, 124.3. The width of the winding chambers 124.1, 124.2, 124.3 is for example 1.35 mm and the diameter of a wire is for example 1.12 mm. Typically, the windings are in direct contact with the separating plates 103 on the left and on the right alternatingly. Since each winding is in direct contact with a metallic separating plate 103, the heat that is generated during operation of the inductive element mainly within the wire windings, is dissipated efficiently by the separating plates 103 that act as a heat sink.

In a further embodiment of the invention, two or more strands are wound in a winding chamber 124.1, 124.2, 124.3 simultaneously. Either two or more wires are fed into the same winding chamber 124.1, 124.2, 124.3 or one wire is folded and then all strands of this wire are fed into the same winding chamber 124.1, 124.2, 124.3 and wound around the coil body. The strands in a winding chamber can either be connected in parallel to form a part of the same winding or they can form parts of different windings of the inductive element.

Figure 20:
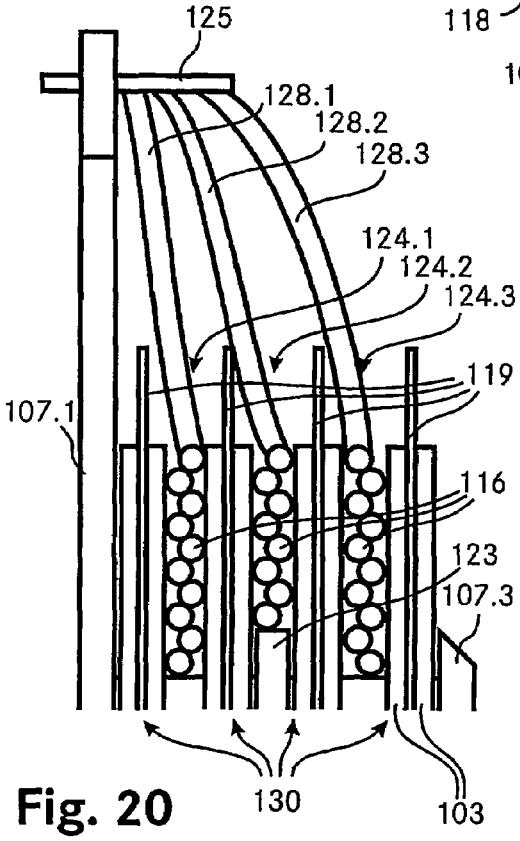

In FIG. 20 a detailed view of a further inductive element with the coil body as shown in FIG. 11–14 is shown. Here, the number of secondary windings is increased by replacing a single separating plate 103 by a plate group 130, that includes two separating plates 103 and an insulation plate 119 between the separating plates 103.

Figure 17:
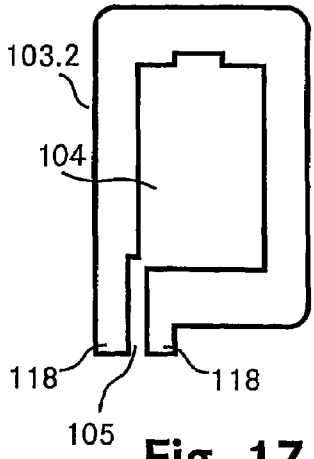
FIG. 17 a second kind of separating plate for the coil body of FIG. 11.

One of the separating plates 103 of a plate group 130 corresponds for example to the separating plate 103.1 as shown in FIG. 16 and the other separating plate corresponds to the separating plate 103.2 as shown in FIG. 17. Some of the separating plates 103 may further be laterally reversed.

Figure 18:
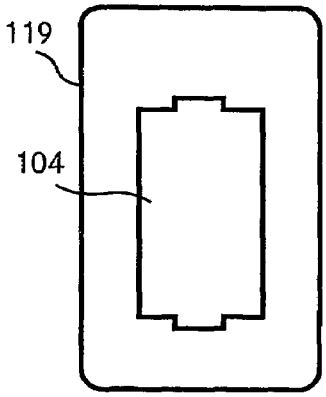
FIG. 18 an insulating plate for the coil body of FIG. 11.

The insulation plate 119 is shown in FIG. 18. While the shape of the opening 104 substantially corresponds to the shape of the opening 104 of the separating plate 103.1, 103.2, the insulation plate 119 is larger than the separating plates 103.1 and 103.2 in length and width. This prevents short circuits between two adjacent separating plates 103 and damages of the isolation of the wires 128.1, 128.2, 128.3 when they are fed from the winding chamber to the pins 125 in order to connect the wires 128.1, 128.2, 128.3 to the pins 125.

In such an arrangement, the terminal projections 118 of the separating plates 103 are located such that they can easily be interconnected to form the desired number of secondary coils and/or number of turns of these coils. In the same way, the number of primary coils and the number of turns of these coils can be controlled by connecting the wires 128.1, 128.2, 128.3 to the pins 125 suitably. That is either interconnecting the wires 128.1, 128.2, 128.3 or connecting the wires to an electric and/or electronic circuit (not shown).

To summarise it can be stated that the invention teaches a coil form which enables the forming of inductive elements which can for example be manufactured very low and flat. Furthermore, an efficient heat dissipation can be achieved thanks to the metallic separating plates which are positioned directly adjacent the heat source.

The invention claimed is:

1. A coil form for forming an inductive element with a core comprising:

a) at least two coils, b) a hollow coil body for insertion of the core, the coil body being made of an electrically insulating material and c) at least two separating plates which surround the outer surface of the coil body thereby providing at least one coil area on the outer surface of the coil body for holding a wire that forms a part of a coil, wherein d) each separating plate is made of metal, includes an opening for pushing the separating plate over the coil body and a slit for prohibiting short circuits and leakage currents within the separating plate, and in that the separating plate forms a winding of another coil;

e) the separating plates are spaced at a specific plate-distance, f) where a ratio of the plate-distance to a diameter of the wire is between 1 and 2.

2. A coil form according to claim 1, wherein the coil body includes a coil portion of a kind of a hollow cylinder for slipping over the separating plate and a flange portion on an end region of the coil portion.

3. A coil form according to claim 2, further comprising two separating plates and in that the coil portion includes a second flange portion on a second end region of the coil portion, the flange portions forming a side support for the separating plates.

4. A coil form according to claim 3, further comprising four separating plates and a projection that surrounds the outer surface of the coil body, the projection forming a side support for two separating plates.

5. A coil form according to claim 4, wherein a ratio of the plate-distance to a diameter of the wire is between 1.1 and 1.4.

6. A coil form according to any of claims 1 to 5, wherein the coil portion includes a recess on an inner surface and an opening in its outer surface in a region of said recess, where said wire is fed from an outside of the coil portion to an inside of the coil portion through said recess and from the inside of the coil portion to the outer surface of the coil portion through said opening.

7. A coil form according to any of claims 1 to 5, wherein said flange portion includes a plurality of holes, where a pin is inserted into at least one hole, said pin being electrically conductively connectable to an end of one of the coils.

8. A coil form according to any of claims 1 to 5, wherein two or more separating plates are electrically conductively connected to form a plurality of windings of the second coil.

9. A coil form according to any of claims 1 to 5, wherein a shape of the opening of the separating plate substantially corresponds to a shape of the outer surface of the coil body and in that an internal diameter of the separating plate is smaller than an outer diameter of the coil body.

10. A coil form according to any of claims 1 to 5, wherein the coil body comprises at least two elements with means to fit the elements together to form the coil body.

11. A coil form according to claim 10, wherein the coil body comprises a first and a second element and in that the means to fit the elements together include a recess on the first element and a corresponding projection on the second element.

12. A coil form according to claim 10, wherein the coil portion is of a kind of a right cylinder, where the coil body is separated into two elements by a plane being perpendicular to a base plane of the right cylindrical coil portion.

13. A coil form according to claim 2, wherein the coil portion includes a recess for positioning of the separating plate and in that the flange portion includes a plurality of terminals where at least one terminal is electrically conductively connectable to an end of one of the at least two coils.

14. A coil form according to claim 1, wherein a single separating plate is replaced by a plate group where each plate group includes two separating plates and an insulation plate between the separating plates.

15. An inductive element with a coil form according to claim 1, further comprising a core inserted into the hollow coil body, a wire provided on the outer surface of the coil body forming a part of a first coil of the inductive element and a metallic separating plate that surrounds the outer surface of the coil body and forms a part of another coil of the inductive element.

16. An inductive element according to claim 15, wherein the core of the inductive element has a shape of two rectangular portions with a common edge, where the common edge is inserted into the hollow coil body and whereby the core includes two E-shaped parts.

17. An inductive element according to claim 15, further comprising at least two coil forms, where the core is inserted into the hollow coil body of each coil form.

18. A method for forming an inductive element with a hollow coil body, a core and at least two coils, comprising: providing a coil area by pushing at least two metallic separating plates with an opening over the coil body and positioning the separating plates at a specific plate-distance by winding a wire in said coil area around an outer surface of the coil body thereby pressing the separating plates against a side support, where a part of a coil is provided by said wire and a winding of another coil is provided by a metallic separating plate.

19. The method according to claim 18, wherein said wire is fed from an outside of the coil body to an inside of the coil body through a recess on an inner surface of the coil body and from said recess to the outer surface of the coil body through an opening in the coil body in a region of said recess.

20. The method according to any one of claims 18 or 19, further comprising providing a plurality of coil areas by pushing a plurality of metallic separating plates over the coil body and spacing them equally at a specific plate-distance and in that a wire is wound around the outer surface of the coil body in each coil area simultaneously.

* * * * *